United States Patent [19]

Steed

[11] Patent Number: 4,790,565

[45] Date of Patent: Dec. 13, 1988

[54] GAME

[75] Inventor: Ivan V. Steed, Stirling, Australia

[73] Assignee: Steed Signs Pty., Limited, Wayville, Australia

[21] Appl. No.: 26,739

[22] Filed: Mar. 17, 1987

[51] Int. Cl.[4] ..... B42D 15/00

[52] U.S. Cl. ..... 283/85; 283/903; 283/81

[58] Field of Search ..... 283/81, 84, 85, 901, 283/902, 903; 106/20, 23; 401/132

[56] References Cited

U.S. PATENT DOCUMENTS

| | | | |
|---|---|---|---|
| 1,167,566 | 1/1916 | Jenkins | 283/85 X |
| 3,068,010 | 12/1962 | Hagodian | 283/85 |
| 3,351,005 | 11/1967 | Giori | 283/903 X |
| 4,163,570 | 8/1979 | Greenaway | 283/85 |
| 4,239,261 | 12/1980 | Richardson | 283/85 |
| 4,299,637 | 11/1981 | Oberdeck et al. | 283/903 X |
| 4,477,593 | 10/1984 | Tomlinson | 283/901 |
| 4,504,084 | 3/1985 | Jauch | 283/901 |
| 4,587,167 | 5/1986 | Maietti et al. | 106/20 |
| 4,597,591 | 7/1986 | Gendron et al. | 283/901 |
| 4,645,239 | 2/1987 | Adams | 283/81 X |
| 4,671,512 | 6/1987 | Bachman et al. | 283/903 X |

*Primary Examiner*—Paul A. Bell

*Attorney, Agent, or Firm*—Pearne, Gordon, McCoy & Granger

[57] ABSTRACT

A game or competition incorporating advertising or promotional matter. The game includes adhesive stickers to be placed on a bumper bar of a vehicle, the sticker comprising printed matter. Portions of the printing are light-fast and other portions fade in sunlight, so that after a period of time the result is determined by the light-fast printing.

6 Claims, 1 Drawing Sheet

GAME

This invention relates to a new game or competition which may be used in a competitive and/or promotional sense.

BACKGROUND OF THE INVENTION

One form of game or competition includes the use of tickets having a perforated flap which is removed or opened to expose a number or letter, the tickets often having a plurality of such flaps and the combination of letters or numbers determining a winner.

Also there is available another game or competition in which a panel is covered by a film of metal which is removed by scratching with a coin or the like to expose a winning number or monetary value.

However, while these are very popular, they are not readily suitable for display for advertising and promotional purposes.

Hence it is an object to provide a game or competition which can be used for promotional or advertising purposes while the game or competition is being run.

A further object is to provide a game or competition in which the result can only be decided after a period of time, the contestants not knowing of the result until after a certain period of time.

BRIEF STATEMENT OF THE INVENTION

Thus there is provided according to the invention a game or competition, the game comprising labels screen printed on an opaque material, labels being provided on a backing sheet, each label and backing sheet having identifying indicia thereon, the indicia on the label being overprinted with a coloured ink, the ink of the winning labels being such that it will fade over a period of time to disclose the winning indicia thereunder, the labels being adapted to be positioned for example on the bumper bar of a motor vehicle so that the covering ink is subject to light and ultra-violet radiation to cause the fading.

BRIEF DESCRIPTION OF THE DRAWINGS

Reference will now be made to the accompanying FIG. 1 showing one form of the invention.

DESCRIPTION OF THE PREFERRED EMBODIMENT

Figure 1:
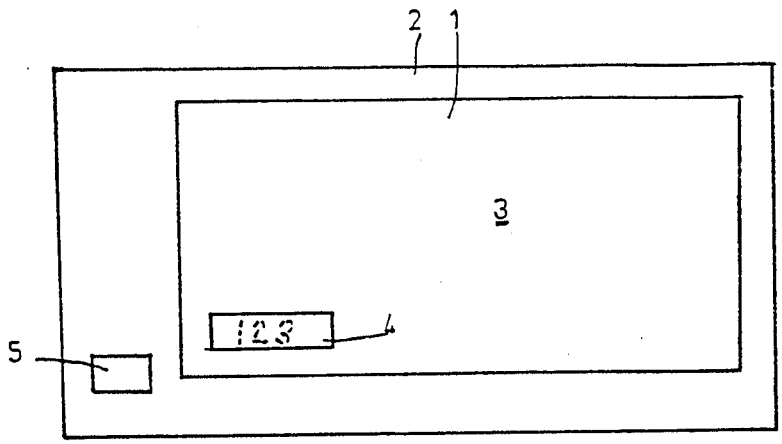

In a preferred form of the invention the labels 1 can be screen printed on opaque material, such as black back vinyl material. The labels can be either die cut, kiss cut or slit so that they can be readily removed from a backing material 2 and positioned on a bumper of a motor vehicle while the major portion 3 of the label can be used for advertising, promotional or other material. There is provided a small area 4 on which a number is screen printed, with a printed portion overlying the number. A majority of the labels will have the printed portion formed by screen printing in non-fading ink, while the winning numbers would be overprinted with a printed panel of the same colour, but are printed by offset printing utilising a printing ink which will face after a period of time.

Preferably the non-fading indicia or number or the like will be printed with a PVC vinyl solvent with a lightfast non-fading yellow pigment. On the winning labels over this is printed an ink comprising non-lightfast fading yellow pigment of the same colour as the lightfast non-fading pigment in the same solvent, that is a PVC vinyl solvent. In this way both inks having the same solvents, it is virtually impossible for any one to tamper with the printed panel by attempting to remove the fading overprint to disclose the number therebeneath. On the non-winning labels, the overprinting is by the same lightfast non-fading ink.

In a more specific form the non-fading pigment may be any one of the known lightfast pigments. The non-lightfast fading pigment is preferably one of the non-lightfast pigments such as Diarylide Yellow Anilide.

Preferably the number or indicia printed on the label with the lightfast ink is printed by screen printing to provide a substantially solid print.

However, the overprinting with the non-lightfast ink is preferably by offset printing. The non-lightfast ink is required to be only thinly printed to cover the indicia, so as to ensure that the ink will fade in the desired time. If it is thicker then a greater fading time is required.

On the backing sheet 2 there is also provided a corresponding indicia or number 5, this can be merely printed on the backing sheet 2, or could be printed on and covered by a scratch off metallic paper, or by being printed with printing which is made visible by ultraviolet light, this identifying panel if tampered with causing the backing sheet 2 to be void.

Thus in order for the winner to collect the prize he must take his identifying backing sheet 2 to the organizers of the game so that the organizers can then check the number on the identifying backing sheet 2 with the bumper sticker so that the person may then collect their prize.

Thus the labels can be cut from the backing sheet 2 or panel, this having to be retained to enable the prize to be collected.

The fading of the overprinting on the sticker may take approximately two or three weeks or even up to three months, and during this time the label will be displayed on the bumper sticker for advertising, promotional or other competition purposes.

The printing on the sticker can have a section or sections which are printed in halftone design. Some of the dots are printed in lightfast ink and some in a non-lightfast ink, and thus all stickers have a section with this halftone effect. The losers could see a message "Sorry—Try again" and the winners "Congratulations, you have won".

Thus these labels can be given away for promotions for advertising only, or can be sold in bulk to form a fund raising form of lottery. Thus the system comprises two advantages, namely the ability to mass expose for organisation benefits, sales promotion, etc., as well as a chance to raise money in a novel and a very effective way.

Thus it will be seen that the invention comprises a novel and effective label utilising in a novel manner the fading of the ink to expose a winning number or indicia or the like underneath so that the label can then be returned with the backing sheet 2 to prove the ownership of the label.

Although one form of the invention has been described in some detail it is to be realised that the invention is not to be limited thereto but can include various modifications falling within the spirit and scope of the invention.

I claim:

1. Game label components comprising a plurality of labels printed on an opaque sheet, said labels being removably attached to a backing sheet, each label and the backing sheet having identifying indicia printed thereon with lightfast ink, the indicia on the label being overprinted with a coloured ink, selected labels which will be the winning labels having the indicia overprinted with a non-lightfast ink which will fade over a period of time to visibly disclose the winning indicia thereunder.

2. Game label components as defined in claim 1, wherein the lightfast ink is a yellow pigment in a PVC vinyl solvent.

3. Game label components as defined in claim 1 wherein the overprinting of the indicia on the winning labels is overprinted by offset printing with a yellow non-lightfast pigment in a PVC vinyl solvent.

4. Game label components as defined in claim 3 wherein the non-lightfast pigment is Diarylide Yellow Anilide.

5. Game label components as defined in claim 3 wherein the backing sheet has its indicia covered by a scratch removable metal film.

6. Game label components as defined in claim 3, wherein the label can be applied to a surface, the label carrying promotional or advertising material.

* * * * *